US006619812B2

(12) United States Patent
Rapisarda

(10) Patent No.: US 6,619,812 B2
(45) Date of Patent: Sep. 16, 2003

(54) ILLUMINATED SHOE OR CLOTHING WITH FORCE RESPONSIVE PULSE RATE

(76) Inventor: Carmen Rapisarda, 21211 Wisteria St., Apple Valley, CA (US) 92308

( * ) Notice: Subject to any disclaimer, the term of this patent is extended or adjusted under 35 U.S.C. 154(b) by 0 days.

(21) Appl. No.: 10/052,298

(22) Filed: Jan. 18, 2002

(65) Prior Publication Data

US 2003/0137852 A1 Jul. 24, 2003

(51) Int. Cl.[7] ..... F21V 21/08

(52) U.S. Cl. ..... 362/103; 362/276; 362/802; 362/394; 362/200

(58) Field of Search ..... 362/276, 802, 362/103, 394, 200

(56) References Cited

U.S. PATENT DOCUMENTS

| | | | | | |
|---|---|---|---|---|---|
| 4,158,922 | A | | 6/1979 | Dana, III | |
| 4,848,009 | A | | 7/1989 | Rodgers | |
| 5,408,764 | A | | 4/1995 | Wut | |
| 5,457,900 | A | * | 10/1995 | Roy | 36/137 |
| 5,483,759 | A | * | 1/1996 | Silverman | 36/137 |
| 5,575,554 | A | * | 11/1996 | Guritz | 362/103 |
| 5,644,858 | A | | 7/1997 | Bemis | |
| 5,649,755 | A | | 7/1997 | Rapisarda | |
| 5,709,464 | A | * | 1/1998 | Tseng | 362/276 |
| 5,746,499 | A | * | 5/1998 | Ratcliffe et al. | 362/103 |
| 5,857,273 | A | | 1/1999 | Rapisarda | |
| 5,894,201 | A | * | 4/1999 | Wong | 315/241 |
| 5,903,103 | A | | 5/1999 | Garner | |
| 5,930,921 | A | * | 8/1999 | Sorofman et al. | 36/137 |
| 5,932,975 | A | * | 8/1999 | Wut | 315/119 |
| 5,945,911 | A | * | 8/1999 | Healy et al. | 340/573.1 |
| 5,969,479 | A | * | 10/1999 | Wong | 315/200 A |
| 6,012,822 | A | * | 1/2000 | Robinson | 362/103 |
| 6,017,128 | A | * | 1/2000 | Goldston et al. | 362/103 |
| 6,065,851 | A | | 5/2000 | So | |
| 6,164,794 | A | * | 12/2000 | Rodgers | 362/103 |
| 6,217,188 | B1 | * | 4/2001 | Wainwright et al. | 362/103 |
| 6,238,056 | B1 | * | 5/2001 | Rapisarda | 362/103 |
| RE37,220 | E | | 6/2001 | Rapisarda et al. | |
| 6,280,045 | B1 | * | 8/2001 | Anteby et al. | 362/103 |
| 6,286,975 | B1 | * | 9/2001 | Rodgers | 362/103 |

* cited by examiner

*Primary Examiner*—Sandra O'Shea
*Assistant Examiner*—Jacob Y. Choi
(74) *Attorney, Agent, or Firm*—John E. Wagner; Robert C. Smith

(57) ABSTRACT

Flashing footwear includes at least one light source located within and/or on footwear so as to be visible directly or indirectly with the light pipe such as heel of the footwear or garment. A power source, such as a battery, provides sufficient power to light the light source. An inertia responsive spring mass electrical switch develops pulses that are directly related to the amount of force to cause illumination flashes in direct response to the force applied to the spring mass switch. The switch is actuated by the condition of motion of the footwear or garment so as to change between open and closed positions and count the number of times the switch is actuated and further to display that count as a set of either a division, multiple, addition, and/or subtraction of the number of times the spring mass makes electrical contacts and to further flash illuminate any number of lights in sequence based on a set count of spring mass electrical contacts.

14 Claims, 3 Drawing Sheets

ILLUMINATED SHOE OR CLOTHING WITH FORCE RESPONSIVE PULSE RATE

BACKGROUND OF THE INVENTION

The present invention relates to footwear and other garments with lighting elements. Footwear and garments with flashing lights have been popular for a number of reasons, including safety, an attractive appearance and simply for a novelty effect.

Lighting units for footwear have typically included a light source, such as one or more light-emitting diodes, a power source, such as a battery and a switch to cause the power source to be connected to the light or lights. Often such units will include electronic circuits which can control the time such lights are actually illuminated, which limits the power consumption, saving the battery. Short-term flashing often makes the display more visible, adding to the safety provided by the units. It also makes a more attractive eye-catching display.

A number of different types of lighting units or circuits have been described in the. prior art. U.S. Pat. No. 4,158,922 to Dana III includes a mercury switch which responds to movements of the foot to turn a light on and off. A mercury switch operated system is also taught in U.S. Pat. No. 4,848,009 to Rogers. U.S. Pat. No. 5,903,103 to Garner includes an oscillator activated by a switch and effective to illuminate lights in shoes when the shoe is lifted from the surface.

Various arrangements have been developed for minimizing battery drain. Applicant's earlier U.S. Pat. No. 5,477,435 issued Dec. 19, 1995, now RE 37,220E shows a light module With an LED having one terminal in contact with one side of a wafer battery, and the other terminal spaced away from the battery but including a weight which will cause the upper terminal to move by inertia in response to a shoe striking a surface to contact the battery to illuminate the LED. In this way, the LED is not illuminated and does not draw power from the battery when the module is at rest. Other modules for illuminating lights in footwear are shown in U.S. Pat. Nos. 5,408,764 and 5,932,975. U.S. Pat. No. 5,932,975 also includes microcircuits with a photosensitive switch to cause illumination to fade and then shut off entirely with full daylight. This is one of a number of battery-saving arrangements in the art.

In the case of other clothing, such as, for example, jackets, it is quite feasible to sew in or otherwise secure the system in the garment. Light from a LED is transmitted through a clear, flexible material, such as plasticized polyvinyl chloride, sewed to the sleeves of the jacket, for example. Such a system is shown in U.S. Pat. No. 5,649,755. There is also an interest in forming such transparent, light-transmitting materials into interesting light flashing patterns along the vamps of the shoes as shown in U.S. Pat. No. 5,857,273.

As a result of observing various types of shoe or clothing illuminating arrangements, it occurred to applicants that an interesting and novel effect would be created if the illumination could be made responsive to the weight or magnitude of the impact of the shoe against a surface.

SUMMARY OF THE INVENTION

Applicants have determined that with the state of the art now including microcircuits which can control the timing of illumination of lights in illuminated footwear, it would be desirable to produce a light module which produces an output varying with impact of the footwear against the surface or even movement, such as an arm or leg in the case of clothing other than footwear. Such a light module would tell one who was watching the illumination from footwear or clothing so equipped whether the wearer of the footwear was walking slowly, or fast or running hard. The availability of comparatively inexpensive miniaturized, but rugged, integrated circuits make it possible to use somewhat more complex control circuits in a module which can be carried in the heel of a shoe or concealed in seams or pockets in clothing.

Applicant's module includes an inertia responsive spring switch in the form of a coil of wire which is cantilevered over an electrical contact on a printed circuit board. With an impact of the footwear against a surface or abrupt movement of body members containing the module, the spring will tend to bounce against the electrical contact a number of times and the number of such contacts will vary depending upon the force or magnitude of the impact, thereby producing a series of positive or negative going electrical spikes or pulses. These spikes or pulses are supplied to a counter circuit which divides or multiplies the number of the pulses by a factor of, for example, four. This results in a number of pulses which still vary with the force of the impact.

This pulse signal is then connected to a synchronous, four-bit counter which distributes the pulses sequentially to a plurality of light sources, in this case three, LEDs which flash in sequence, the number of flashes depending on the number of pulses supplied to the synchronous counter circuit. Of course, there may be fewer or more than three LEDs. Alternatively, the LEDs may be connected to flash simultaneously.

Also receiving a pulse input from the string of pulses produced from the switch at impact is a timer circuit. This pulse input starts the timer circuit counting time for a set period, such as one second, after which it supplies a reset pulse to the synchronous four-bit counter, causing it to stop counting and to return to a zero input condition. This stops the LEDs from flashing until the next impact or force initiates a new string of pulses. The number of flashes per impact then varies with the force of the impact; however, the flashes will continue for only the time set on the timer. In this way, one shoe of a pair will normally flash only for a time during which the other is not flashing.

Similarly, if the LEDs are located in sleeves of a jacket, and movement or force of a wearer's arm causes the spring switch to produce pulses, the LEDs in the sleeves will flash and this will continue until the timer stops counting, after which there will be no more flashing until the next such force occurs.

BRIEF DESCRIPTION OF THE DRAWINGS

This invention may be more clearly understood with the following detailed description and by reference to the drawings in which.

DESCRIPTION OF THE PREFERRED EMBODIMENT

Figure 1:
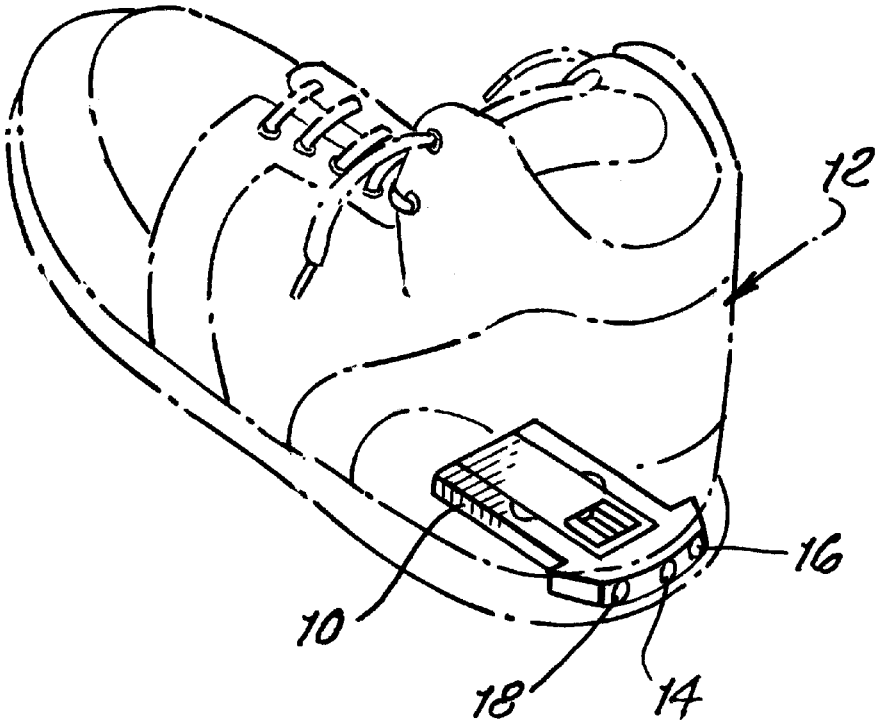
FIG. 1 is a perspective view of a light module according to the present invention installed in the heel of a shoe, which is shown in phantom.

A module, according to the invention, includes a housing 10, preferably placed in the heel of a shoe 12 shown in phantom in FIG. 1. Housing 10 includes or is connected to a plurality of light-emitting diodes 14, 16, and 18 installed in the shoe.

Figure 2:
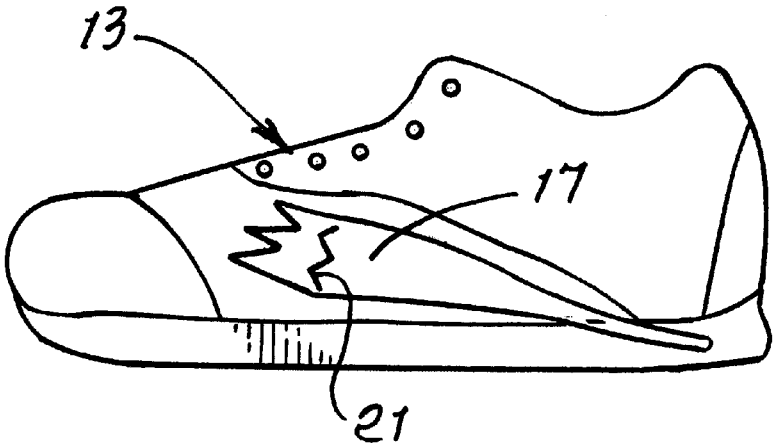
FIG. 2 is a side elevational view of a shoe having a patterned, flexible lighting strip along its vamp.

FIG. 2 is a side elevational view of a shoe 13 having a patterned, flexible, lighted strip 17 positioned along its vamp, as described in U.S. Pat. No. 5,857,273. Strip 17 may be connected to a housing, such as housing 10 carried in the heel of the shoe containing one or more LEDs which, when illuminated, cause light to be carried along strip 17. Strip 17 includes a number of cuts or marks 21 which can be formed in any desired position, such as a trademark, and which reflect light.

Figure 3:
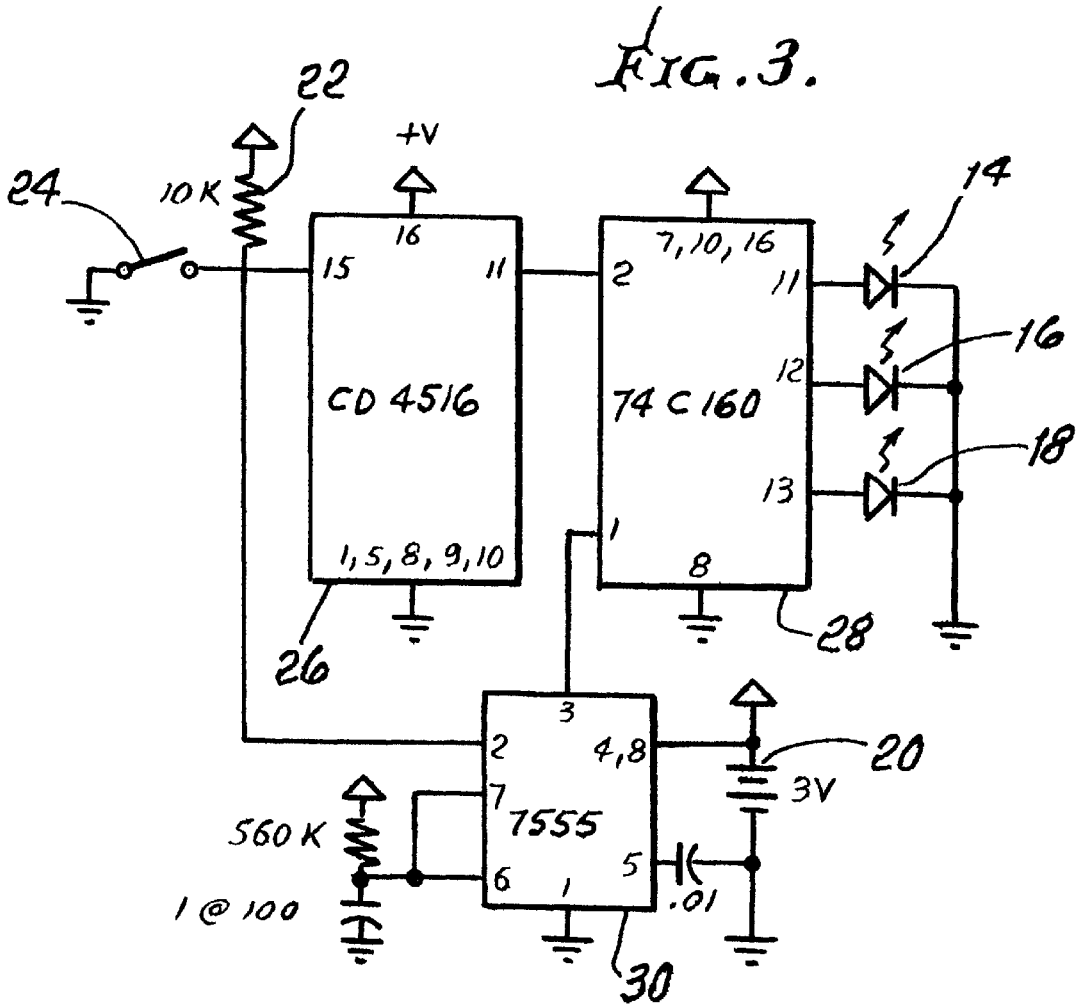
FIG. 3 is a schematic diagram of the circuit used in the present invention.

In FIG. 3, a power source, which may be a 3-volt battery 20, is connected through a resistor 22 to a spring switch 24. This power source is also connected to a CD4516 cmos counter 26 and a synchronous four-bit counter 74C160 shown at numeral 28. A 7555 timer 30 is connected to battery 20 and to receive the input signals supplied to cmos counter 26.

An impact of the shoe 12 of FIG. 1 or shoe 13 of FIG. 2 against a surface will cause a rapid vibration of spring switch 24 resulting in a series of positive spikes at the clock input of cmos counter 26, as well as at the trigger terminal of timer 30. This causes timer 30 to begin counting for a set period, which, in this application, would typically be one second.

Figure 4:
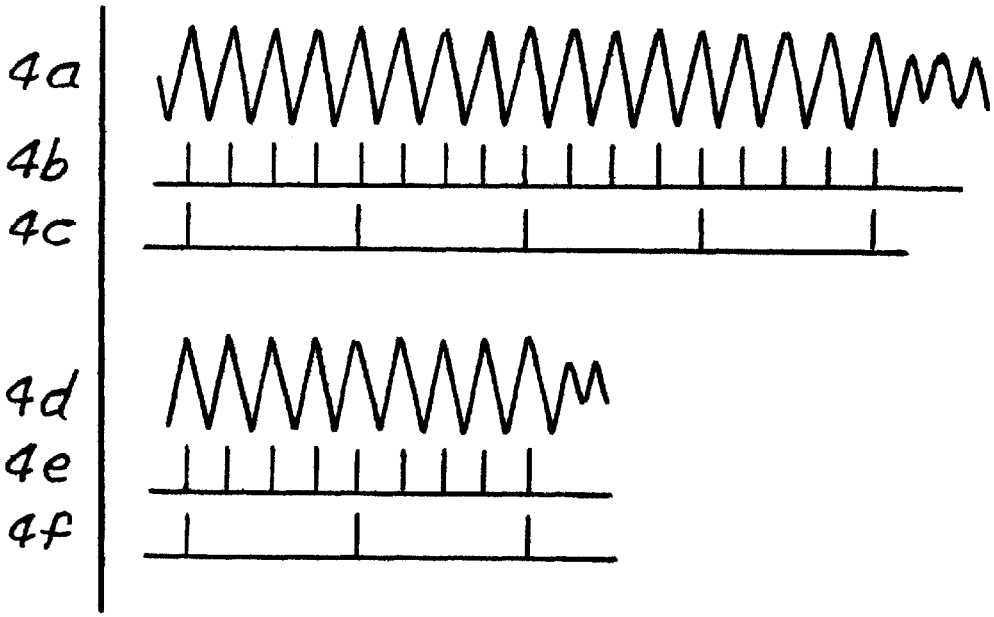
FIG. 4 is a series of waveforms indicating signals at various points in the circuit of FIG. 2, and the lighted pulse emitted.

FIG. 4 includes graphs of a number of waveforms occurring in the circuit of FIG. 3. Waveform 4*a* indicates the pattern of spring vibration from a heavy impact of the shoe 12 against the ground. The spring switch 24 will tend to vibrate a significant number of times at a relatively high amplitude and will then taper off to a much smaller amplitude before it quits vibrating altogether. Vibrations of housing 10 sufficient to cause switch 24 to close will each produce a voltage pulse or spike resulting in a series of positive going spikes, waveforms 4*b*, at the clock input to the CD4516 cmos counter 26.

The series of positive-going spikes supplied to cmos counter 26 will each be counted for spring switch vibrations of amplitude sufficient to close switch 24. This series of vibrations, which may be a fairly large number, is divided in cmos counter 26 by a set integer to produce a smaller number of output pulses which number is still in proportion to the number of closings of switch 24, as shown in FIG. 4*c*, caused by the impact of the shoe 12 against a surface. Those output pulses are then supplied to counter 28. Counter 28 is connected to distribute pulses to the three LEDs 14, 16, and 18, which flash in sequence based on the number of pulses supplied to counter 28. These LEDs will continue to flash until timer 30 sends a reset pulse to counter 28, which resets counter to a zero output state. This produces the visual effect of, for example, lights flashing in sequence around the heel of the shoe 12 of FIG. 1 or through lighted strip 17 of shoe 13. It could as well supply all pulses to all three LEDs simultaneously.

With a light impact of the shoe against a surface, the spring switch 24 would close a fewer number of times as shown in graph 4*d*, producing fewer pulses at the input to cmos counter 26 (graph 4*e* ) and fewer divided pulses from counter 26 as shown in graph 4*f*. This smaller number of pulses will be distributed sequentially to LEDs 14, 16 and 18 as described above. The observer watching the movement of either shoe 12 or shoe 13 will see fewer lights flashing than in the case where the impact of the shoe against the surface is of greater force and can thereby judge by the duration of each series of light flashes whether the wearer of the shoe was walking slowly, walking rapidly or running.

The preferred embodiment of the invention employs:

Cmos synchronous programmable 4-bit counter of Texas Instruments Type

Cmos presettable up/down counter Type 74C160 of Texas Instruments;

National Semiconductor Timer Type LM555/LM555C timer;

Type T-1 ¾ LEDs of Kingbright Electric Co.

3V lithium battery, Type CR-2032.

It will be recognized that the described system may be varied in a number of ways. In particular, the number and arrangement of light sources on or around a shoe could involve either more or fewer than three light sources. All the light sources may be on the shoe or some may be elsewhere on the wearer's clothing.

Figure 5:
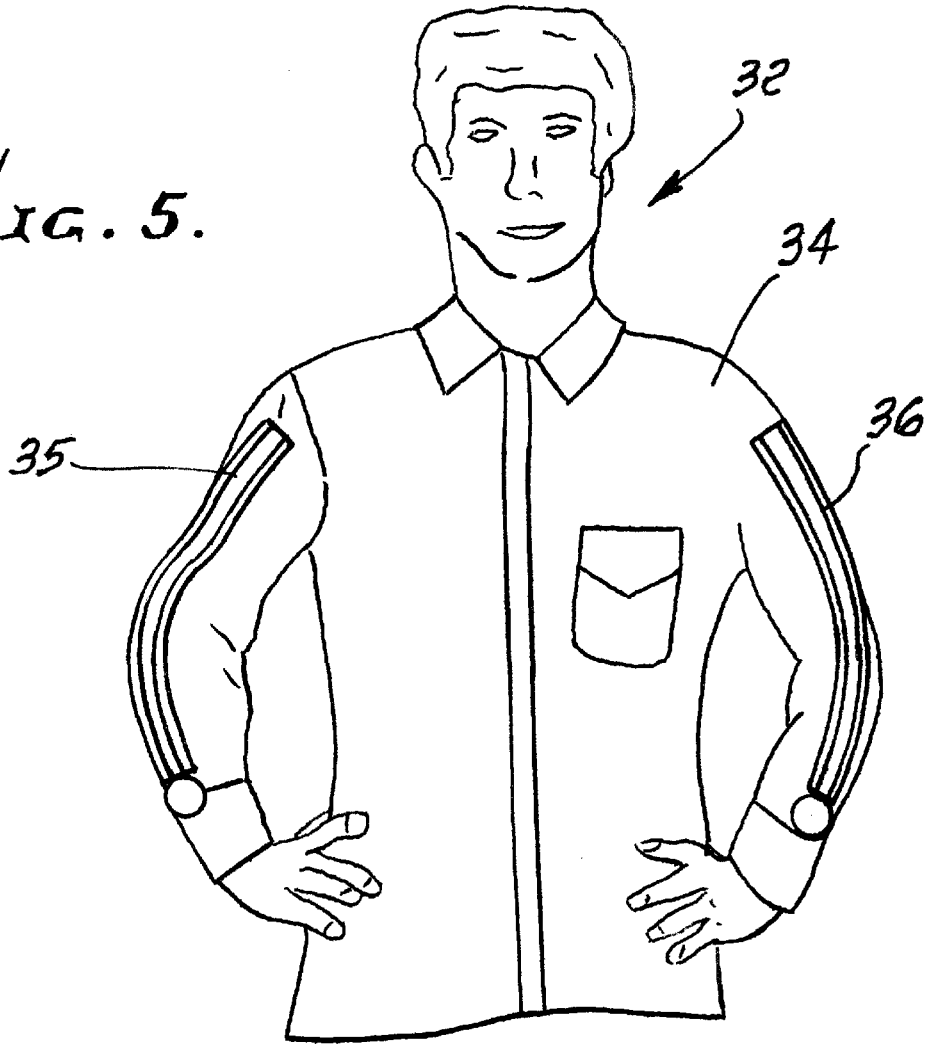
FIG. 5 is a view of an individual wearing an article of clothing incorporating a patterned, flexible lighting strip.
Figure 6:
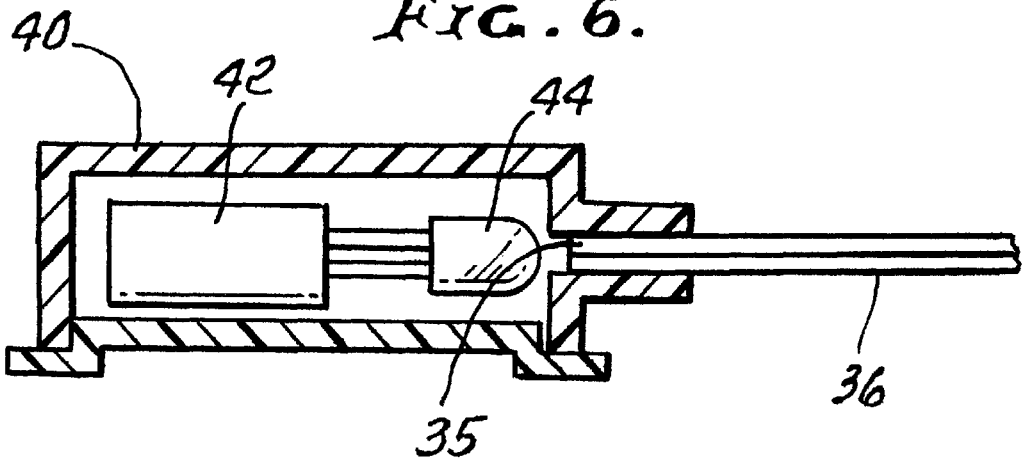
FIG. 6 is a view, partly in section, of a battery, switch and circuit assembly in a housing with a lamp directed toward a light transmitting strips such as those shown in FIG. 2 or FIG. 5.

FIG. 5 is a front view of an individual 32 wearing an article of clothing, specifically a jacket or shirt 34 having light-transmitting strips 35 and 36, preferably of plasticized polyvinyl chloride, secured to its sleeves. Details of this garment and lighting strips are described in greater detail in U.S. Pat. No. 5,649,755. Light-transmitting strips 35 and 36 are secured to a housing 40 (FIG. 6) containing a battery, switch assembly, and the circuits of FIG. 4 in a circuit 42 connected to a LED 44. Housing 40 includes a switch and system such as that described above in connection with FIG. 4 wherein illumination of lamp or LED 44 causes light to travel through strip 35 and 36. Any desired pattern of cuts or irregularities in strips 35 and 36 will flash, as described above, upon certain abrupt movement of the arms of wearer 32.

Housing 40 may be sewed into the sleeves of garment 34 such that abrupt movement of the arms of individual 32 will have the effect of causing the spring, switch 24 to vibrate, sending flashing lights along light-transmitting strips 35 and 36. These strips may also be cut or interrupted as described above to display desired patterns.

The above-described embodiments of the present invention are merely, descriptive of its principles and are not to be considered limiting. The scope of the present invention instead shall be determined from the'scope of the following claims including their equivalents.

I claim:

1. A lighting system for incorporation in clothing comprising:

at least one light source located so as to be visible at an external surface of the clothing, said light source providing illumination when turned on;

a power source capable of supplying sufficient power to said light source to cause it to provide the illumination;

a switch connected to said power source and responsive to abrupt movement of said clothing, said switch producing an output consisting of a series of electrical pulses for each said abrupt movement, the number of said pulses varying with the magnitude of the force of said abrupt movement; and means receiving said output and connecting said output to said light source to cause said light source to produce an output, the duration of which varies with the magnitude of the force of said abrupt movement on said switch.

2. The lighting system of claim 1 further comprising means dividing said switch output to provide a series of pulses the number of which varies with the magnitude of the force of said abrupt movement and means connecting said pulses to said light source.

3. The lighting system of claim 1 further comprising a synchronous timer connected to receive said series of pulses and said light source comprises a plurality of separate light sources connected to said synchronous timer which flash in sequence based on the number of pulses in said pulse output.

4. The lighting system of claim 2 further comprising a timer circuit responsive to the initiation of pulses from said switch for timing said pulses, and after a set period, disconnecting said pulses from said light source.

5. The lighting system of claim 3 further comprising a timer circuit responsive to the initiation of pulses from said switch for resetting said synchronous timer after a set time period.

6. The lighting system of claim 1 wherein said switch is a spring switch.

7. A lighting system for incorporating in footwear comprising:

at least one light source located so as to be visible at an external surface of the footwear, said light source providing illumination when turned on;

a power source connected to said light source and capable of supplying sufficient power to cause it to provide the illumination;

a switch connected to said power source and responsive to each impact of said footwear against a surface, said switch producing for each said impact a series of electrical pulses the number of said pulses varying with the force of said impact;

a circuit connected to receive said electrical pulses connected to said light source to cause said light source to produce a series of light flashes, the number of which varies with the magnitude of said force.

8. The lighting system of claim 7 further comprising a counter circuit responsive to the initiation of pulses from said switch counting a given number of said pulses and for disconnecting said circuit from said light source after said given number of pulses have been counted.

9. The lighting system of claim 7 wherein said circuit includes a synchronous timer and said light source comprises a plurality of separate light sources connected to said synchronous timer which flash in sequence based on the number of pulses in said pulse output.

10. The lighting system of claim 7 wherein said switch is a spring switch.

11. The lighting system of claim 7 wherein at least some of said light sources are light-emitting diodes.

12. A lighting system for incorporating in footwear comprising;

at least one light source located so as to be visible on an external surface of said footwear;

a power source connected to said light source capable of providing sufficient power to cause illumination of said light source;

a switch connected to said power source and responsive to impact of said footwear against a surface, said switch producing for each impact a series of electrical pulses in which the number of pulses varies with the magnitude of said impact;

a divider circuit connected to receive said series of electrical pulses producing electrical output pulses the number of which vary with the pulse output of said switch; and a synchronous timer connected to receive the output of said divider circuit connected to said light source to cause said light source to produce a series of light flashes, the number of which varies with the magnitude of said impact.

13. The lighting system of claim 12 further comprising a timer circuit responsive to the initiation of pulses from said switch for resetting said synchronous timer after a set time period.

14. The lighting system of claim 12 wherein said switch is a spring switch.

* * * * *